US005297671A

United States Patent [19]

Rüth

[11] Patent Number: 5,297,671

[45] Date of Patent: Mar. 29, 1994

[54] CADDY FOR THE INDEPENDENT INDIVIDUAL TRANSPORTING OF COPS AND COP TUBES IN A TRANSPORT SYSTEM OF A TEXTILE MACHINE

[75] Inventor: Gregor Rüth, Moenchengladbach, Fed. Rep. of Germany

[73] Assignee: W. Schlafhorst AG & Co., Moenchengladbach, Fed. Rep. of Germany

[21] Appl. No.: 945,688

[22] Filed: Sep. 16, 1992

[30] Foreign Application Priority Data

Sep. 21, 1991 [DE] Fed. Rep. of Germany ..... 4131527

[51] Int. Cl.[5] ..... B65G 29/00

[52] U.S. Cl. ..... 198/803.12; 198/465.1; 57/281; 242/35.5 A

[58] Field of Search ..... 198/803.01, 803.12, 198/465.1; 242/35.5 A; 57/281, 90

[56] References Cited

U.S. PATENT DOCUMENTS 4,984,422 1/1991 Stadele et al. ..... 242/35.5 A
5,184,713 2/1993 Nakagawa ..... 198/803.12 X
5,185,993 2/1993 Fritschi et al. ..... 57/281

FOREIGN PATENT DOCUMENTS 7301717 5/1973 Fed. Rep. of Germany .
3841812A1 7/1990 Fed. Rep. of Germany .
4217330 12/1992 Fed. Rep. of Germany ..... 57/281

*Primary Examiner*—Cheryl L. Gastineau
*Attorney, Agent, or Firm*—Shefte, Pinckney & Sawyer

[57] ABSTRACT

The invention relates to a caddy for the mutually independent individual transport of cops and cop tubes and provides a caddy that can be used for different tube diameters, which is achieved by forming the mandrel and base plate of the caddy from separate molded parts. The base plate can be connected securely but detachably and form-fittingly with mandrels of different dimensions for correspondingly differing diameters. The base plate has a central opening with an undercut while the mandrel has an inwardly elastically resilient arrangement of legs that fit over the undercut.

6 Claims, 3 Drawing Sheets

CADDY FOR THE INDEPENDENT INDIVIDUAL TRANSPORTING OF COPS AND COP TUBES IN A TRANSPORT SYSTEM OF A TEXTILE MACHINE

FIELD OF THE INVENTION

The present invention relates to a caddy for the mutually independent individual transport of cops and cop tubes in a transport system of a textile machine, especially a bobbin winder, which caddy has a base plate by which it rests on moving transport means, e.g., a conveyor, and an upstanding mounting mandrel for mounting the cops.

BACKGROUND OF THE INVENTION

Textile machine transport systems in which caddies for cops and cop tubes circulate on transport paths formed by rail-like transport channels for the base plates of the caddies have been known for some time, for example, from Japanese Patent Application 52 25 139. German published, unexamined Patent Application 39 19 542 describes a transport system of this kind, in which the caddies are passed substantially inside the bobbin winder in various transport loops, including through the winding station.

German published, unexamined Patent Application 40 16 466 describes a caddy that has an elastic element for the secure holding or carrying of the cop on the mounting mandrel.

These caddies are each dimensioned for a specific cop size.

SUMMARY OF THE INVENTION

The object of the present invention is to provide a caddy of the aforementioned type that is suitable for cops of varying tube diameters.

According to the present invention, this object is attained by forming the mandrel and the base plate as separate components, e.g., as individually molded plastic parts, wherein the base plate can be selectively connected securely but releasably, and form-fittingly, to any one of a plurality of compatibly formed mandrels of various dimensions appropriate for differing tube diameters, without requiring additional elements or aids.

Since the transport systems of the bobbins winders as a rule are invariable in the dimension of the transport tracks, the same size of the base plates typically is always used. However, since the cops or cop tubes may differ from one another in internal diameter, conventional caddies could heretofore be used only for a specific tube dimension. The present invention now makes it possible to use the same base plate for most various dimensions of cop tubes, by merely replacing the mandrel. The form-fitting but releasable connection is secure and can be carried out very quickly.

In the preferred embodiment, an undercut can be provided in a central opening of the base plate to assure a snap-type connection of the removable mandrels which does not release unintentionally, for instance when the particular tube seated on the mandrel is removed by a doffer. By means of a cap on the underside of the base plate, a flexible part of the mandrel fitting over the undercut, e.g., resilient legs of the mandrel, can be compressed by an inner edge of the cap to such an extent that removal of the mandrel is possible. After disengagement from the undercut in the base plate, the mandrel is displaced a predetermined further amount by the cap so that, once the cap is released, the mandrel cannot lock into place again. The mandrel can then be readily pulled off the base plate. Slipping a mandrel on the base plate is simply done until its resilient legs lock into place behind the undercut. The shaping of the elastic mandrel legs and the base plate cap are selected such that, after this locking, no further vertical motion of the mandrel in the base plate is possible. Drive ribs are also provided, which prevent reciprocal or other relative rotation between the base plate and the mandrel. As a result, the cop can be rotated, for example, if only the base plate of the caddy is driven. A transfer of the rotary notion to a supported cop or cop tube is likewise assured via a spring basket that is seated on the mandrel and presses resiliently against the inside of the cop tube.

A ring can additionally be included in the plug-in connection between the mandrel and the base plate. Depending on its dimensions, the ring forms a pedestal of a selected diameter above the base plate.

Different pedestal diameters of this kind can be used, for example, to identify and distinguish the caddies, so that at selecting devices, for instance, different cop types that are associated with the differing pedestal diameters can be distinguished. An adaptation to different base plate diameters of caddies toward the spinning machine can also be done in a transfer station, as described in German Patent Application P 40 34 824.5.

DESCRIPTION OF THE PREFERRED EMBODIMENT

Figure 1:
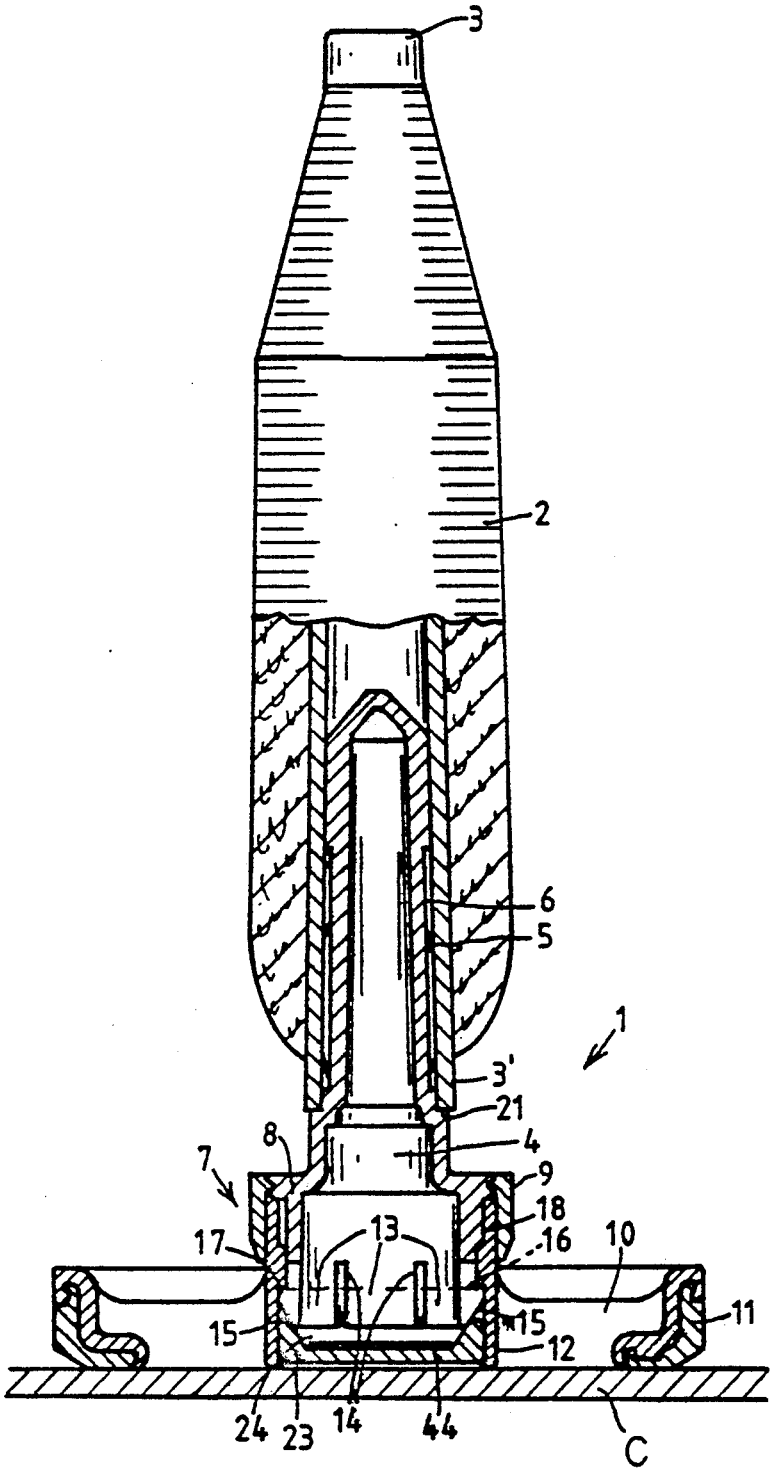
FIG. 1 is a vertical cross-sectional view of a caddy according to the present invention, carrying a cop.

The caddy 1 in FIG. 1 is shown resting on a transport conveyor C and carries a cop 2 on its mounting mandrel 4, the cop 2 being held telescopically on the mandrel by the tube 3 of the cop. The mandrel has a spring basket 5 of elastic or other resilient material (see FIG. 2) of the kind described in German published, unexamined Patent Application 40 16 466, for instance. As a result, the cop 2 with its tube 3 is held very securely on the mandrel 4. The tube bottom 3' rests on a shoulder 21 of the mandrel 4. The spring basket 5 is inserted into a tapered region 6 of the mandrel 4, in order to secure its vertical position within narrow limits.

The mandrel 4 has a profiled body 8 which is inserted into a correspondingly shaped profiled body 12 of the base plate 10, forming a plug-in connection. The profiled mandrel body 8 has elastic or resilient legs 13 on its lower end portion, which are separated by slits 14. These elastic legs 13 in turn have conical terminal ends 15, each of which has an undercut surface 16.

As can be seen in FIG. 1, this undercut 16, in the assembled state of the caddy 1, engages behind a corresponding undercut surface 17 of the profiled body 12 of the base plate 10. A closure flange 19 of the profiled body 8 also fits over a bead 20 of a spacer ring 9. The bead 20 engages in a groove 20', which is located below the closure flange 19 of the profiled body 8 (see FIG. 2).

The base plate 10 is provided with an annularly encompassing metal ring 11, which can for instance be used to enable controlling of the caddies with the aid of magnets at shunts of the transport tracks.

An axial central opening 24 formed inside the profiled body 12 of the base plate 10 is closed from the underside of the base plate 10 by a cap 23. On the side of the cap 23 facing inwardly toward the opening 24, a microchip 44 may be accommodated, which can be coupled in contactless fashion to a reading, erasing, and encoding apparatus, e.g., via an antenna which is directly connected to the chip and is likewise centrally disposed by means of the central disposition of the cap 23. Thus, an information-process connection with a reading, erasing, and encoding apparatus can be achieved regardless of the angular position of the caddy.

Figure 2:
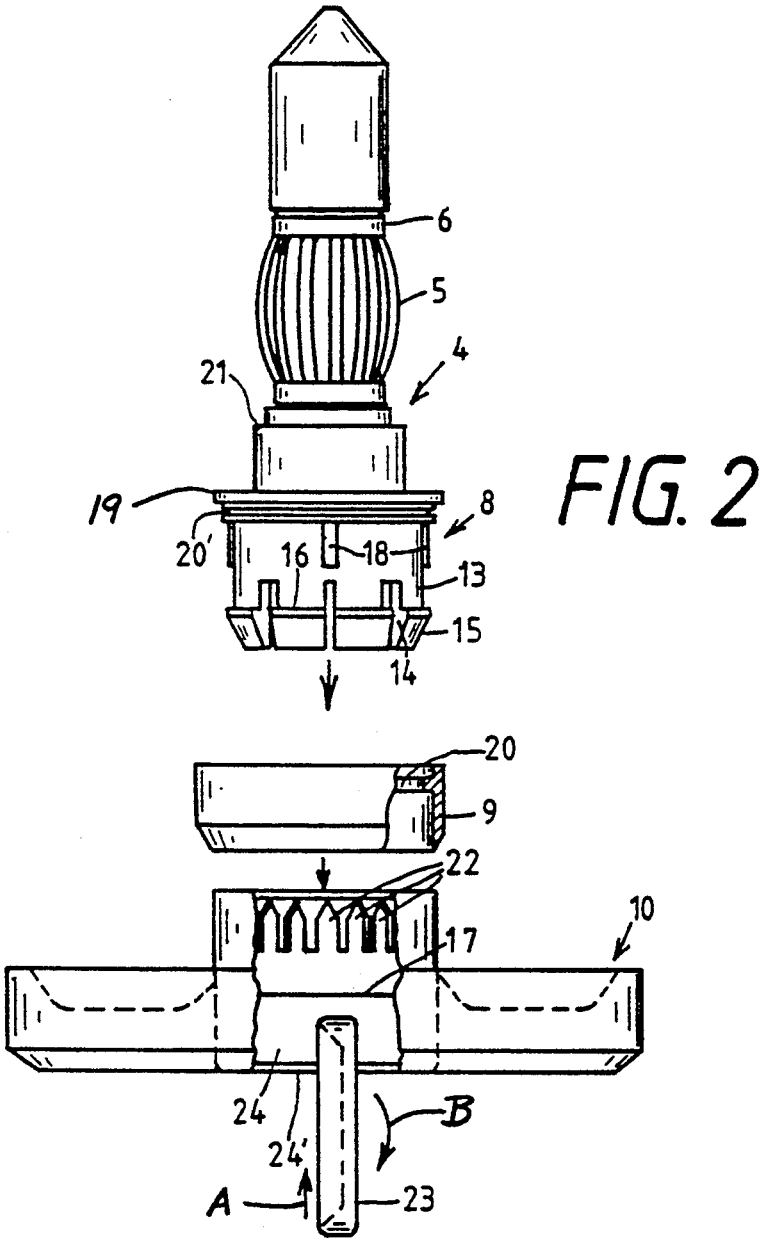
FIG. 2 is an exploded side elevational view of the various parts of the caddy of FIG. 1, with the base plate partially broken away.

FIG. 2 shows an exploded view of the assembly of components forming the caddy 1 according to the present invention. To assemble the components, first the cap 23 is inserted from below into the opening 24 of the base plate 10. This cap 23 must move past a bead 24', whose inside diameter is slightly less than the outside diameter of the cap 23. If, however, the cap 23 is introduced vertically to its latter position in the caddy in the manner shown in FIG. 2 and indicated by directional arrow A, then the material of the base plate 10, which is typically plastic, correspondingly yields in the region of the bead 24'. After the insertion of the cap, the cap is rotated 90° to its latter position, as indicated by directional arrow B. In that condition, it can no longer move downward past the bead 24' again. Next, the spacer ring 9 is slipped axially downwardly onto the profiled body 12 of the base plate 10 in the manner shown. Finally, the mandrel 4 is introduced axially downwardly into the opening 24 of the base plate 10. In the process, because of their shaping, the elastic legs 13 deflect inwardly at their conical terminal ends, which is made possible by the intervening slits 14.

Vertically disposed drive ribs 18 are formed at circumferential spacings on the outward annular surface of the mandrel body 8 to enter between teeth 22, which are chamfered at the top, formed in the profiled body 12 of the base plate 10. In combination with the teeth 22, these drive ribs 18 prevent relative rotation between the base plate 10 and the mandrel 4. Because of the distribution of the teeth 22 around the entire circumference of the profiled body 12, no specific angular position is prescribed for mounting the mandrel 4 in the base plate 10.

The mandrel 4 is inserted into the base plate 10 sufficiently far that the undercut 16 of the legs 13 of the mandrel 4 locks into place behind the undercut 17 in the opening 24 of the base plate 10. At the same time, the closure flange 19 of the mandrel 4 rests on the spacer ring 9. The spacer ring 9 is additionally locked into place by engagement of its bead 20 in the groove 20' of the mandrel 4 and is securely held.

It is clear from this illustration that very simple and rapid assembly of a caddy according to the present invention is possible. It is also clear that a secure connection between the individual parts can be achieved without additional instruments, connecting elements, or other aids.

Figure 3:
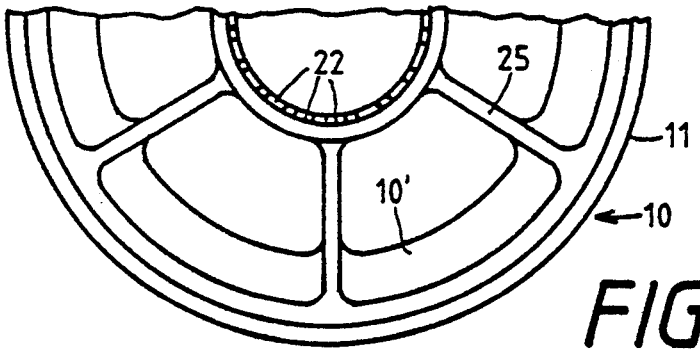
FIG. 3 is a fragmentary plan view of the base plate of the caddy of FIGS. 1 and 2.

FIG. 3 shows a fragmentary plan view of the base plate 10 of a caddy. An annular outer ring or rim 10' of the base plate 10 is connected to the profiled body 12 via a plurality of radially-extending circumferentially-spaced spokes 25. In this way, for any given size of base plate, its mass and consumption of material are reduced.

Figure 4:
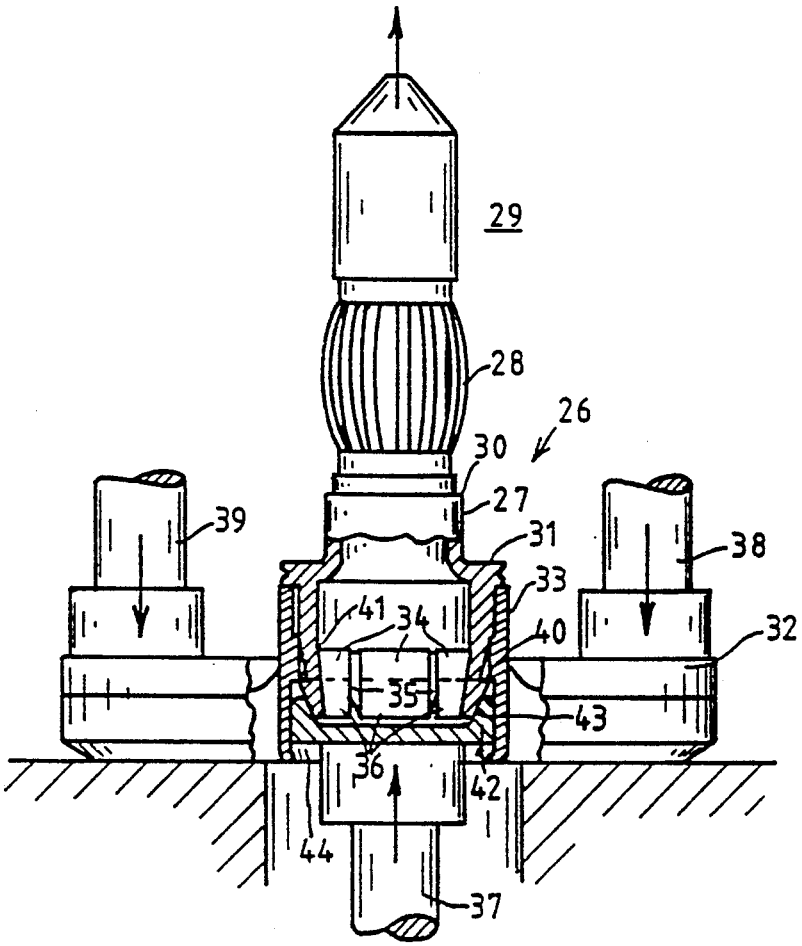
FIG. 4 is a partially sectioned side elevational view of another embodiment of a caddy, showing its disassembly operation.

FIG. 4 shows an alternative embodiment of a caddy according to the present invention, in the process of disassembly. In this embodiment, a spacer ring 9 is dispensed with, which demonstrates that the present invention is not limited to the use of a spacer ring of this kind.

The disassembly of the caddy is accomplished in a simple manner by means of a ram 37 acting upon the cap 42 from the underside of the caddy, while the base plate 32 is kept pressed against a firm foundation by means of two counterpressure rams 38,39. The cap 42, with its conical inside wall 43, presses increasingly against the conical terminal leg portions 36 of the elastic legs 34 during the upward motion of the ram 37. As a result, the legs 34 are pivoted inward, thereby narrowing the intervening slits 35. Once the cap 42 has reached a specific height, the largest outer circumference of the elastic legs 34, at their undercut 41, is equal to or less than the inner diameter of the profiled body 33 of the base plate 32 above its undercut 40.

Once the two undercuts 40,41 no longer engage one another, the continuing movement of the cap 42 acts to displace the mandrel 27 upwardly far enough that the undercut 41 is located above the undercut 40, so that the mandrel 27 and the base plate 32 are no longer interlocked. Once the uppermost position of the cap 42 is reached, the mandrel 27 can then be pulled off by hand. A new insertion of a mandrel of a different diameter can then be made, as already described.

In the caddy of FIG. 4, a shoulder 30, on which a tube bottom of a cop can rest, is provided above the profiled body 31 of the mandrel 27. Above a spring basket 28, a centering segment 29 is also provided to center cop tubes as they are slipped onto the mandrel 27 and can also hold them until they have been slipped all the way onto the spring body 28.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A caddy for the independent individual transporting of cops and cop tubes in a transport system of a textile machine, comprising a base plate for removable resting disposition on moving transport means and a mounting mandrel upstanding from the base plate for mounting the cops, the mandrel and the base plate being formed as separable component parts which can be selectively connected securely, but releasably, to one another to enable the mandrel to be replaced by mandrels of differing dimensions for corresponding tube diameters.

2. The caddy of claim 1, wherein the base plate has a central opening with an undercut and the mandrel has a connection element which is elastically resilient inwardly to fit over the undercut.

3. The caddy of claim 2, wherein the elastically resilient element of the mandrel comprises an annular arrangement of elastic legs each having a conical end portion forming an undercut.

4. The caddy of claim 3, wherein a cap is movably inserted into the central opening of the base plate, the cap having an axially oriented inner wall of a diameter less than the maximum outside diameter of the annular leg arrangement of the mandrel and the cap being displaceable to engage its inner wall with the annular leg arrangement of the mandrel to pivot the legs until they are disengaged from the undercut in the base plate.

5. The caddy of claim 1, wherein the base plate and the mandrel have form-fittingly cooperating parts to secure against relative rotation.

6. The caddy of claim 1, wherein a ring is mountable annularly about the mandrel adjacent the base plate to form a pedestal of a selected diameter, the ring being jointly connected to the mandrel and the base plate.

* * * * *